US005890967A

United States Patent [19]

Allen

[11] Patent Number: 5,890,967

[45] Date of Patent: Apr. 6, 1999

[54] GOLF BALL EJECTING APPARATUS AND METHOD OF OPERATION THEREOF

[76] Inventor: William Wayne Allen, 224 Garrett, Wharton, Tex. 77488

[21] Appl. No.: 939,850

[22] Filed: Sep. 29, 1997

[51] Int. Cl.[6] ..... A63B 57/00

[52] U.S. Cl. ..... 473/178

[58] Field of Search ..... 473/176, 177, 473/178, 180, 181, 182, 183, 184, 186, 190, 191, 192, 194, 409

[56] References Cited

U.S. PATENT DOCUMENTS

| | | | |
|---|---|---|---|
| 3,792,861 | 2/1974 | Coleman | 473/178 |
| 3,874,665 | 4/1975 | McCulloch et al. | 473/178 |
| 4,290,603 | 9/1981 | Barnes | 473/177 |
| 5,018,730 | 5/1991 | Iliuta | 473/178 |
| 5,393,053 | 2/1995 | Wiese et al. | 473/177 |
| 5,445,374 | 8/1995 | Clark, Jr. | 473/191 |
| 5,480,142 | 1/1996 | Ackerman | 473/177 |
| 5,674,131 | 10/1997 | Forbes et al. | 473/177 |

*Primary Examiner*—Steven B. Wong
*Attorney, Agent, or Firm*—Maryam Bani-Jamali

[57] ABSTRACT

The present invention is a golf ball ejecting apparatus that comprises a sleeve and a main body featuring a solenoid system and surrounded by and attached by sealants to the sleeve. The main body comprises a solenoid-driven plunger, a guide tube, a power source, a housing for the power source, phototransistors, solenoid coil, tapered coil springs, insulating tape, a control circuit panel, a flag stick tube, a golf cup and an end plate. The end plate is positioned under the guide tube and serves as a bottom cover for the main body. The solenoid-driven plunger slides in the guide tube which is positioned under the flag stick tube. The golf cup is positioned above the flag stick tube. The insulating tape is wrapped around the solenoid coil which is wrapped around the flag stick tube. Tapered coil springs connect the power source to the solenoid coil. The control circuit panel is placed on the insulating tape and is connected to the phototransistors. The phototransistors are embedded in the housing for the power source and are actuated and are used to selectively actuate the golf ball ejecting system upon a quick removal of a shadow previously cast upon them. Upon triggering the phototransistors, an electrical circuit is established through the power source and the conductive strip, resulting in an exertion of an abrupt upward force by the solenoid coil on the solenoid-driven plunger.

19 Claims, 3 Drawing Sheets

GOLF BALL EJECTING APPARATUS AND METHOD OF OPERATION THEREOF

BACKGROUND OF THE INVENTION

1. Field of the Invention

This invention relates to a golf ball ejecting apparatus and to the method of operation of the golf ball ejecting apparatus. The golf ball ejecting apparatus comprises a sleeve and a main body that is surrounded by and attached by sealants to the sleeve. The main body, featuring a solenoid system, comprises a guide tube, a solenoid-driven plunger sliding in the guide tube, a power source, a housing for the power source, phototransistors that are embedded in the housing for the power source and that are actuated upon quick removal of a shadow previously cast upon them, a flag stick tube positioned above the guide tube, solenoid coil wrapped around the flag stick tube, insulating tape wrapped around the solenoid coil, tapered coil springs connecting the power source to the solenoid coil, a control circuit panel placed on the insulating tape and connected to the phototransistors, a golf cup positioned above the flag stick tube and an end plate positioned under the guide tube.

2. Description of the Prior Art

A wide variety of golf ball ejecting apparatuses for retrieving balls from target golf cups have been developed within the past few decades.

In U.S. Pat. No. 5,445,374, by Clark, Jr., issued Aug. 29, 1995, a golf driving range system is patented that includes a flag pole and a sensor which detects the presence of a golf ball. An actuator and a vacuum pump are used to move a door. Upon detecting the presence of the golf ball, the sensor actuates the door and enables the golf ball to pass through a tube in which a vacuum is applied so that the golf ball returns to the original player who hit the ball. However, there is no provision for the ejection of the golf ball from the cup.

In U.S. Pat. No. 3,792,861, issued on Feb. 19, 1974, by Coleman a ball projecting golf cup is patented. The ball projecting golf cup comprises a hollow body that is open at its top, includes a ball supporting and ejecting member mounted in the golf cup for vertical shifting below an upper limit position and has a compression spring. There is a mechanical downward displacement of the ball supporting and ejecting member, causing a subsequent displacement of the golf ball by an upward displacement of the golf ball supporting and ejecting member. An upwardly facing suction cup is mounted below the compression spring and is engageable by a downwardly facing surface portion of the ball supporting and ejecting member when the ball supporting and ejecting member is forced downwardly. A putter handle is used to push the golf ball down so as to set the compression spring. When the compression spring is released, the golf ball is projected upward and out of the golf hole.

In U.S. Pat. No. 3,874,665, issued on Apr. 1, 1975, by McCulloch et al., a golf cup featuring the use of flexing diaphragm and/or impacting cup to impart impacting force to a golf ball is patented. A telescoping coil and magnet system operates to trigger a control circuit which, in turn, causes the telescoping coil and magnet system to interact and impart impacting force to the golf ball. A pivoting impacting cup provides a multidirectional, pivotal movement to the golf ball.

In U.S. Pat. No. 4,290,603, issued on Sep. 22, 1981, by Barnes, a ball-ejecting golf cup utilizing a spring-biased plunger disposed within the golf cup is patented. The ball and the spring-biased plunger are depressible by the golfer with any suitable tool, causing the ejection of the golf ball upwardly.

In U.S. Pat. No. 5,018,730, issued on May 28, 1991, by Iliuta, a golf ball cup ejecting apparatus is patented. The golf ball cup ejecting apparatus has an elongate cylindrical aligned housing that includes a solenoid organization. The solenoid organization causes displacement of the golf ball from the golf ball cup through an audibly actuated switch. Upon actuation, a plunger moves upward toward a diaphragm which then moves upward toward and hits the resting golf ball, resulting in the ejection of the golf ball from the golf ball cup. The actuation of the golf ball cup ejecting apparatus via a hand clapping noise usually requires the use of both hands simultaneously. A limitation of the patent is that the golfer usually is most probably holding his putter club in one hand while actuating the golf ball cup ejecting apparatus. Additionally, there is no provision for a flag pole in the golf ball cup.

The above-listed patents and many other similar inventions have been developed.

Inasmuch as there are inherent limitations with the current state of the art, there remains a need for a suitable golf ball ejecting apparatus without such limitations which is simple enough so as to be readily accepted by the golfing public. The invention herein described meets the criteria. The construction of a full-size prototype has completely verified its performance as described herein.

SUMMARY OF THE INVENTION

A primary object of this invention is to devise a golf ball ejecting apparatus that is of simple, durable and reliable construction.

Another object of this invention is to devise a golf ball ejecting apparatus that conforms to conventional forms of manufacture and is attainable at a low cost of manufacture with regard to both materials and labor.

Still another object of this invention is to devise a golf ball ejecting apparatus that can be selectively and easily actuated.

Yet another object of the invention is to devise a golf ball ejecting apparatus that is simple, efficient and safe to use.

An additional object of the invention is to devise a golf ball ejecting apparatus that is economically feasible, long-lasting and relatively trouble-free in operation.

Another object of this invention is to devise a golf ball ejecting apparatus that is characterized by a high degree of resistance to adverse environmental conditions and a prolonged operating life.

Still another object of this invention is to devise a golf ball ejecting apparatus that provides a drainage system for any entering fluid.

A final object of this invention is to provide a golf ball ejecting apparatus that assists to minimize damage to the turf on putting greens around golf cups.

Additional objects and advantages of the invention will be set forth in part in a detailed description which follows, and in part will be obvious from the description, or may be learned by practice of the invention.

The present invention provides a golf ball ejecting apparatus, that is designed and equipped for use on regular putting greens and practice greens of a golf course, and the method of application thereof. The golf ball ejecting apparatus comprises a sleeve and a main body that is surrounded by and attached by sealants to the sleeve. The main body features a solenoid system and comprises a solenoid-driven plunger, a guide tube, a power source, a housing for the power source, phototransistors, solenoid coil, tapered coil springs, insulating tape, a control circuit panel, a flag stick tube, a golf cup and an end plate. The end plate is positioned under the guide tube and serves as a bottom cover for the main body. The solenoid-driven plunger slides in the guide tube. The flag stick tube is positioned above the guide tube. The golf cup is positioned above the flag stick tube. The solenoid coil is wrapped around the flag stick tube. The insulating tape is wrapped around the solenoid coil. Tapered coil springs connect the power source to the solenoid coil. The control circuit panel is placed on the insulating tape and is connected to the phototransistors. The phototransistors are embedded in the housing for the power source and are actuated upon a quick removal of a shadow previously cast upon them.

The phototransistors are used to selectively actuate, via actuating the solenoid system, the golf ball ejecting system. The solenoid-driven plunger ejects the golf ball from the golf cup. The design of the golf ball ejecting apparatus provides for accommodating the unrestricted use of a solenoid system and a power source which results in a unique combination of features not presented previously.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

DETAILED DESCRIPTION OF THE PREFERRED EMBODIMENT

Preferred embodiments of the present invention are illustrated in any charts, tables, examples and drawings that are included.

Figure 1:
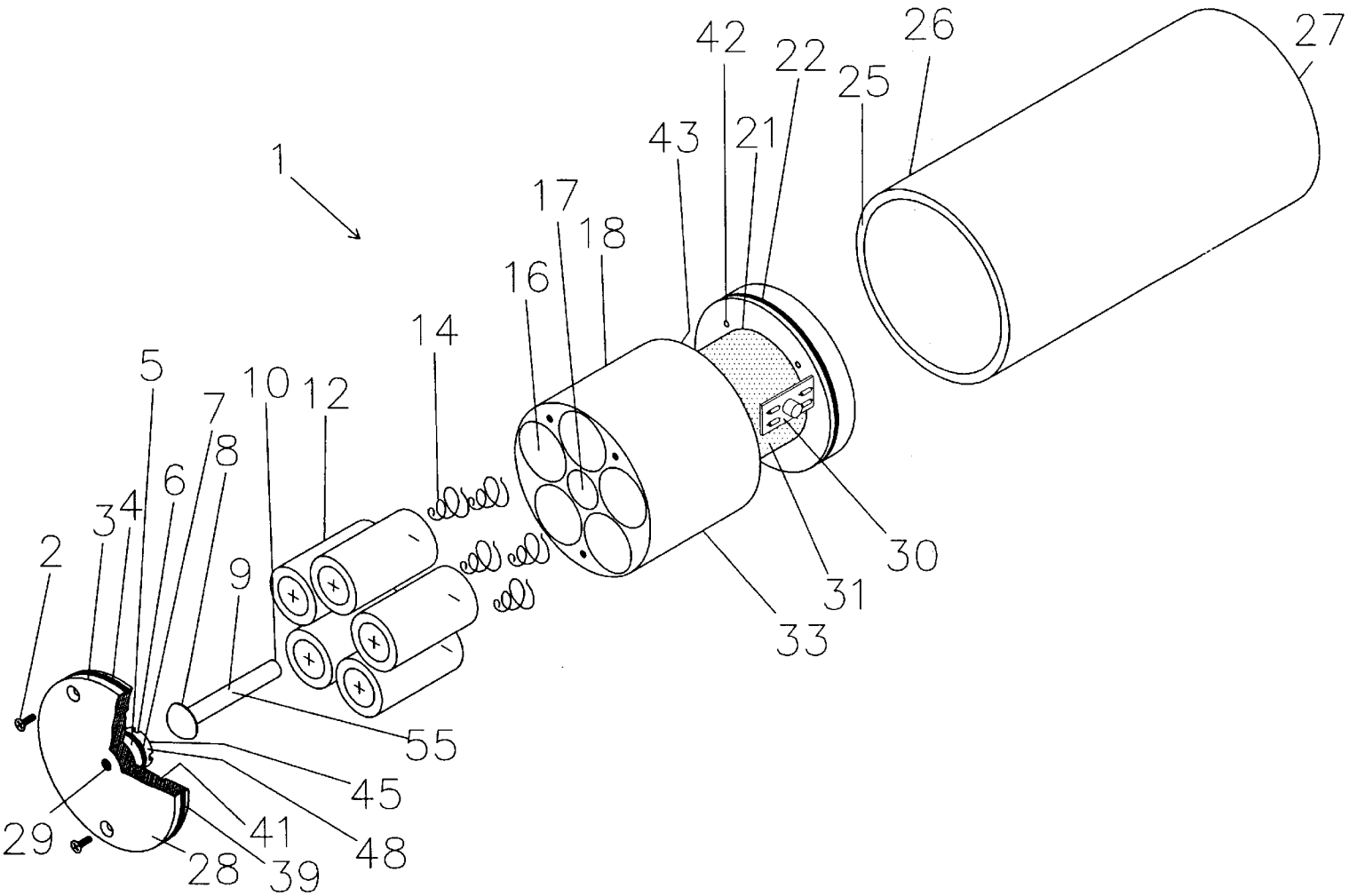
FIG. 1 shows an exploded, angular isometric view of a golf ball ejecting apparatus comprising a main body surrounded by a sleeve.

The present invention provides a golf ball ejecting apparatus 1 that comprises a sleeve 26 and a main body 18 that is surrounded by and attached by sealants to the sleeve 26. The main body 18, featuring a solenoid system 33, comprises a solenoid-driven plunger 55, a guide tube 17, a power source 12, a housing 16 for the power source 12, phototransistors 32, solenoid coil 21, tapered coil springs 14, insulating tape 31, a control circuit panel 30, a flag stick tube 35, a golf cup 34 and an end plate 28. (Please refer to FIG. 2.) The end plate 28 is positioned under the guide tube 17. The solenoid-driven plunger 55 slides in the guide tube 17. The flag stick tube 35 is positioned above the guide tube 17. The golf cup 34 is positioned above the flag stick tube 35. The phototransistors 32 are embedded in the housing 16 for the power source 12 and are actuated upon a quick removal of a shadow previously cast upon them. The insulating tape 31 is wrapped around the solenoid coil 21 which is wrapped around the flag stick tube 35. The control circuit panel 30 is placed on the insulating tape 31 and connected to the phototransistors 32. In a preferred embodiment, the control circuit panel 30 is glued upon the insulating tape 31. (Please refer to FIG. 2.) Different attachment means 2 may be used among the components of the golf ball ejecting apparatus 1. For example, as shown in FIG. 1, screws are used as attachment means 2 to secure the end plate 28 against the main body 18. However, some components of the golf ball ejecting apparatus 1 may be formed integrally and be welded, cemented or otherwise rigidly affixed in the golf ball ejecting apparatus 1. It is emphasized that these drawings and descriptions are examples and are intended to be interpreted as illustrative only of the principles of the invention and are not in a limiting sense.

The sleeve 26 is a hollow tube with an upper end 27 and a lower end 25 (refer to FIG. 1). The sleeve 26 preferably is formed of metal, plastic or any other suitable structural material, adapted to be mounted in the earth of a golf green with its axis disposed vertically and its open upper end 27 can be flush with or slightly below the ground surface. The sleeve 26 surrounds all components of the main body 18 of the golf ball ejecting apparatus 1. The sleeve 26, the main body 18 and the golf ball ejecting apparatus 1 share a central, longitudinal axis. The sleeve 26 is co-axially securable to the main body 18 which is positioned within the sleeve 26. Some empty space remains within the sleeve 26 on top of the golf cup 34 for receiving the golf ball and some empty space remains within the sleeve 26 below the end plate 28. The golf cup 34 is positioned closest among other components of the main body 18 to the upper end 27 of the sleeve 26. The end plate 28 is positioned closest among other components of the main body 18 to the lower end 25 of the sleeve 26. Preferably, the end plate 28 is positioned at a certain distance away from and above the lower end 25 of the sleeve 26. (Please refer to FIG. 2.) The distance between the end plate 28 and the lower end 25 of the sleeve 26 shall provide an amount of surface area under the end plate 28 that is large enough to permit draining of any amount of fluid which enters the golf cup 34, whether it be rain water or irrigation water applied for the maintenance of the golf greens. In a preferred embodiment, the end plate 28 is positioned at approximately 0.25 inches above the lower end 25 of the sleeve 26.

Figure 2:
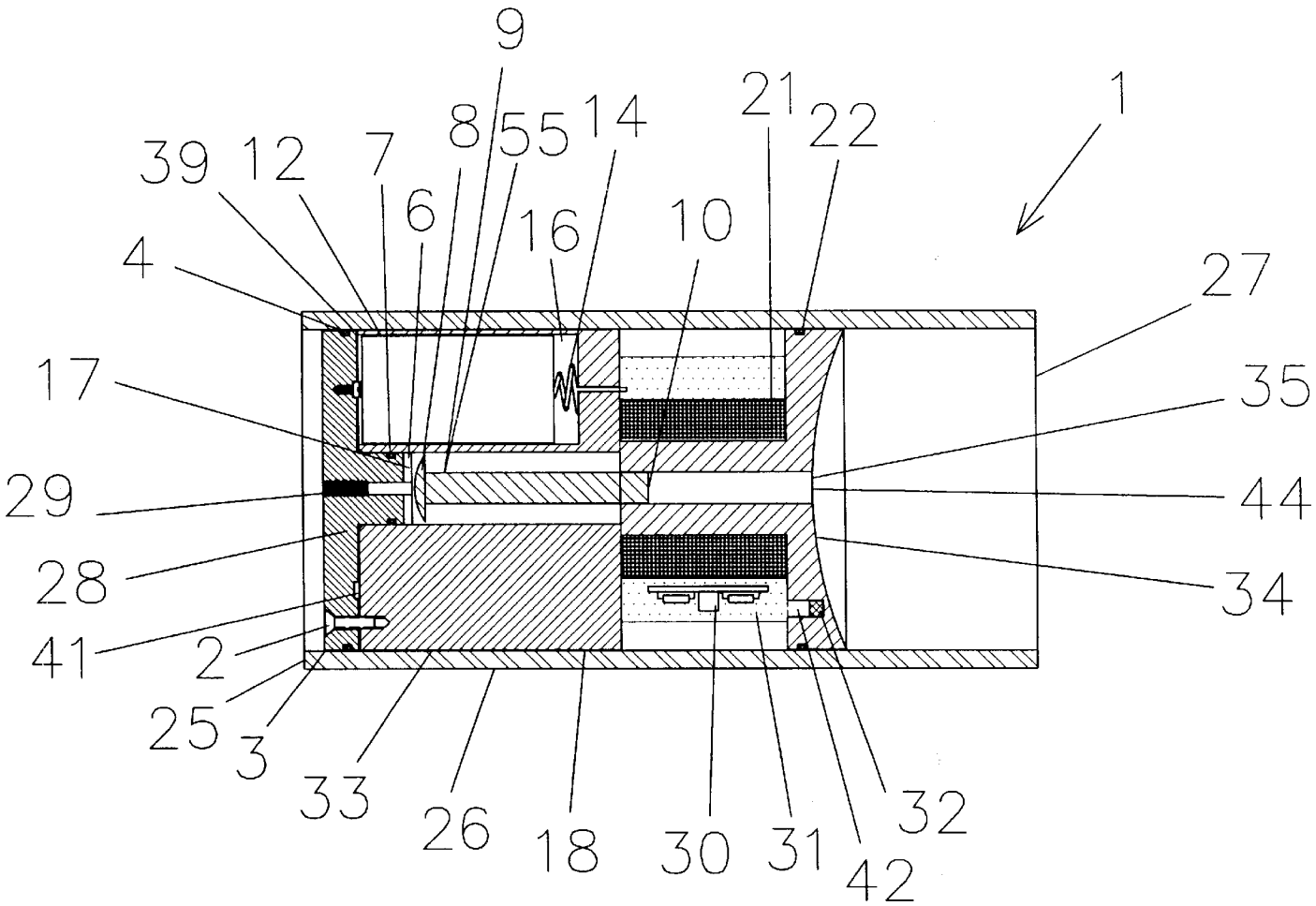
FIG. 2 shows an isometric cross-sectional view of the golf ball ejecting apparatus of FIG. 1.

In a preferred embodiment, the end plate 28 is positioned normal to the central, longitudinal axis of the golf ball ejecting apparatus 1 (as demonstrated in FIG. 2). The end plate 28 has a bottom section 3, a top section 39, a sealant 4 between the bottom section 3 and the top section 39, a conductive strip 41 attached to the top section 39 and a guiding cap 48 attached to and positioned above the top section 39 of the end plate 28. (Please refer to FIG. 3.) The conductive strip 41 can be removably or irremovably attached to the top section 39 of the end plate 28 or can be manufactured as an integral component of the end plate 28 or of the main body 18. The guiding cap 48 comprises a top portion 45, a bottom portion 5 and a sealant 7 that is between the bottom portion 5 and the top portion 45. The guiding cap 48 is perpendicular to the top section 39 of the end plate 28 and is co-axial with the central, longitudinal axis of the golf ball ejecting apparatus 1. At the top portion 45 of the guiding cap 48 are some drainage ports 6. (Please refer to FIG. 3.) The drainage ports 6 lead to a drain hole 29 that passes through the top portion 45 and the bottom portion 5 of the guiding cap 48 and through the top section 39 and the bottom section 3 of the end plate 28, thus facilitating drainage of any fluid that enters the golf cup 34. The drain hole 29 is preferably centrally located in the end plate 28 (as shown in FIGS. 1 and 2). To facilitate repair and exchange of the power source 12, the end plate 28 shall be easily removable, replaceable and repositionable. In order to avoid the need of using hooks, the drain hole 29 is preferably threaded. Any water or other fluid which enters the golf cup 34, is drained via the drainage ports 6 through the drain hole 29 out of the golf ball ejecting apparatus 1. Any water or other fluid which enters the golf cup 34 through the upper end 27 of the sleeve 26 will drain downward through the flag stick tube 35 and will subsequently drain through the guide tube 17, passing around the solenoid-driven plunger 55, and then exit the golf ball ejecting apparatus 1 via the drainage ports 6 and then through the drain hole 29.

Sealants are used to substantially prevent interference of water, dust, soil, sand, grass clippings and such foreign matter with the operation of the solenoid system 33. Allowance of entry of such foreign matter into the solenoid system 33 of the golf ball ejecting apparatus 1 results in fouling of the solenoid system 33. Adjacent to the upper end 27 of the golf ball ejecting apparatus 1, a sealant 22 is used between the sleeve 26 and the golf cup 34 in order to prevent the entrance of any external particles into the main body 18 via any space that may exist between the sleeve 26 and the golf cup 34. Adjacent to the lower end 25 of the golf ball ejecting apparatus 1, a sealant 4 is used in between the sleeve 26 and the end plate 28 in order to prevent the entrance of any external particles into the main body 18 via any space that may exist between the sleeve 26 and the end plate 28. A sealant 7 is also used between the guide tube 17 and the guiding cap 48 of the end plate 28 in order to prevent the entrance of any external particles via the drainage ports 6 of the guiding cap 48 into the main body 18. The above listed sealants 4, 7 and 22 are required for the proper operation of the golf ball ejecting apparatus 1. An application of additional sealants is optional. A balance of increasing prevention of interfering foreign matter versus increasing costs of sealants has to be determined. Neoprene-O-Rings are among sealants that may be used for manufacturing the present invention.

Figure 3:
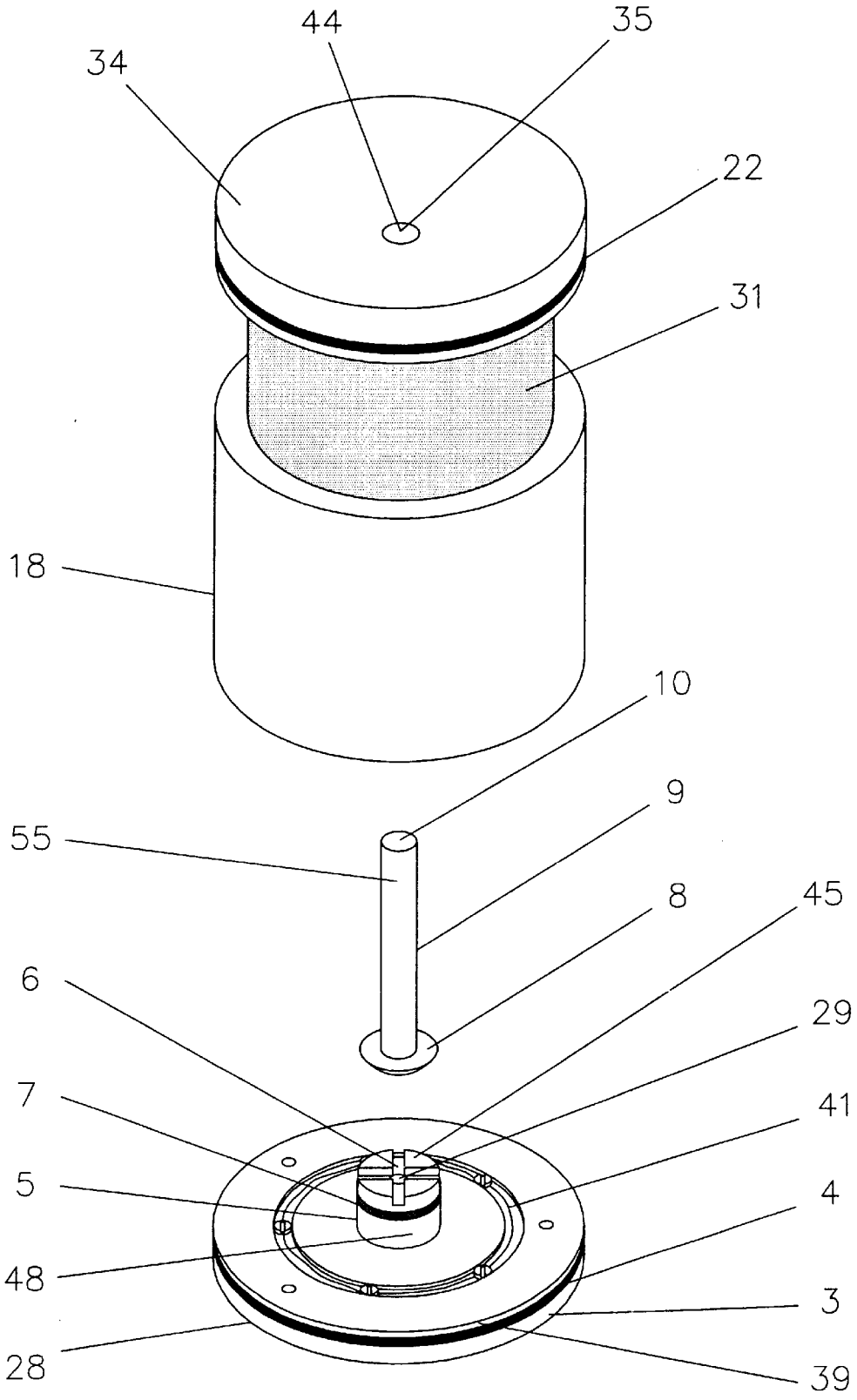
FIG. 3 shows a perspective view of some components of the main body of the golf ball ejecting apparatus of FIG. 1.

The solenoid-driven plunger 55 shares a central, longitudinal axis with the sleeve 26, the guide tube 17, the flag stick tube 35 and the golf cup 34. (Please refer to FIG. 2.) The solenoid-driven plunger 55 is positioned perpendicularly to the top section 39 of the end plate 28. The solenoid-driven plunger 55 comprises a guiding head 8, a cylindrical body 9 and a striking face 10 (as shown in FIG. 3). In a preferred embodiment, the solenoid-driven plunger 55 is positioned and slides normally to the top section 39 of the end plate 28 and in parallel to the sleeve 26, with the guiding head 8 being closer than the striking face 10 to the end plate 28 at all times. The guiding head 8 and the cylindrical body 9 have diameters of different measurements, with the diameter of the guiding head 8 being slightly larger than the diameter of the cylindrical body 9. The dimensions of the solenoid-driven plunger 55 are adjusted to ensure a vertical sliding movement of the cylindrical body 9 and the striking face 10 of the solenoid-driven plunger 55 through the guide tube 17 and through the flag stick tube 35. The diameter of the guiding head 8 is slightly smaller than the diameter of the guide tube 17 which enables the solenoid-driven plunger 55 to slide up and down through the guide tube 17 with essentially no resistance, when the solenoid-driven plunger 55 has been actuated. The diameter of the cylindrical body 9 and of the striking face 10 of the solenoid-driven plunger 55 are slightly smaller than the diameter of the flag stick tube 35 to ensure a vertical sliding movement, with essentially no resistance, of the solenoid-driven plunger 55 throughout the flag stick tube 35. However, the diameter of the guiding head 8 is larger than the diameter of the flag stick tube 35, thus avoiding any ejection of the solenoid-driven plunger 55 from the flag stick tube 35. Since the diameter of the flag stick tube 35 is smaller than the diameter of the guiding head 8 of the solenoid-driven plunger 55, a barrier is created against the guiding head 8. Said barrier stops the solenoid-driven plunger 55 from being thrown out of the golf ball ejecting apparatus 1. Preferably, the solenoid-driven plunger 55 is a single piece of magnetic-sensitive metal.

Different means of energy can be used as the power source 12. The power source 12 is stored in a housing 16 in the main body 18. A number of cavities in the main body 18 can serve as a housing 16 for the power source 12. In a preferred embodiment shown in FIGS. 1, 2 and 3, the golf ball ejecting apparatus 1 is designed to accommodate a number of batteries as the power source 12. Practically, a number of D Cell batteries, each having a positive and a negative end, would perform satisfactorily in the preferred embodiment shown in FIGS. 1, 2 and 3. A number of cavities serve as the housing 16 for the D Cell batteries, arranged as shown in FIG. 1, with the positive end of each battery directed toward the end plate 28 and the negative end of each battery directed toward the golf cup 34.

In a preferred embodiment, tapered coil springs 14 are inserted into electrical feed-through holes 43 existing in the housing 16 of the main body 18. Each tapered coil spring 14 connects each unit of the power source 12 to the solenoid coil 21. Each tapered coil spring 14 is positioned adjacent to the negative end of each corresponding unit of the power source 12. Electric solder connection of each tapered coil spring 14 is inserted through an electrical solder connection feed-through hole 43 in each respective cavity and each unit of the power source 12 is connected to a common wire for the electrical circuit. The negative end of each unit of the power source 12 is inserted into each corresponding cavity first, which enables the positive end of each unit of the power source 12 to come in contact with the conductive strip 41 of the end plate 28 after the end plate 28 is in place. If several units are used as the power source 12, the units may be arranged in a circumferential pattern (as shown in FIG. 1), with the units being disposed in parallel relationship to one another. The circumferential arrangement of the units of the power source 12 provides, in essence, a barrier or wall defined by the power source 12 and encircling the guide tube 17. In a preferred embodiment, the units of the power source 12 may be disposed such that the positive ends of the units of the power source 12 are facing downwardly toward the end plate 28, while the negative ends of the units of the power source 12 are facing upwardly toward the golf cup 34. The positive ends of adjacent units of the power source 12 may be interconnected by a conductive strip 41. The conductive strip 41 serves as a common positive connection and is connected through the main body 18 and extended to the positive end of the power source 12 for use in the electrical circuit. (Please refer to FIGS. 2 and 3.) When the electrical circuit is closed, the solenoid system 33 is actuated.

A novel feature of the present invention that deserves emphasis is the utilization of a solenoid system 33 in a golf ball ejecting apparatus 1. The control circuit panel 30 is connected to optical implant holes 42 and to phototransistors 32. The tapered coil springs 14 are inserted into the feed-through holes 43. Solenoid coil 21 is wrapped around the flag stick tube 35 and extends from under the optical implant holes 42 adjacent to the phototransistors 32 to where the electrical feed-through holes 43 terminate. The control circuit panel 30 is placed on (e.g. glued upon a layer of) electrical insulating tape 31 that is placed over the surface of the wrapped solenoid coil 21. After all the connections of the different sections of the solenoid system 33 are completed, a potting compound is applied to the exposed surface so as to completely waterproof the solenoid system 33, waterproofing the solenoid coil 21, connections and the control circuit panel 30. In a preferred embodiment, the control circuit panel 30 is disposed as shown in FIG. 1. Any conventional, electrically non-conductive, fluid plastic potting compound may be applied so as to provide a totally waterproof and environment-proof circuit installation. Of course prior to such potting, electrical connections shall be made between the power source 12 and the electrical circuit, as well as between the power source 12 and the conductive strip 41 of the end plate 28.

The phototransistors 32 are embedded in the translucent material from which the golf ball ejecting apparatus 1 is constructed. The light which penetrates the phototransistors 32 is diffused but, yet, adequate to impart the response of the phototransistors 32.

The phototransistors 32 in the electrical circuit and the power source 12 are used to selectively actuate the solenoid system 33. Preferably, the golf ball ejecting apparatus 1 includes three phototransistors 32 that are positioned approximately 120 degrees apart and one-half inch from the edge of the golf cup 34 and three-sixteenth inch below the upper surface of the golf cup 34.

The golf cup 34 is provided with a drainage hole 44 penetrating its lower edge. (Please refer to FIGS. 2 and 3.) The golf cup 34 serves as an upwardly opening central seat and is positioned at some distance below the upper end 27 of the sleeve 26, such that sufficient empty space remains on the upper section of the sleeve 26 for receiving of a golf ball by the golf cup 34. The golf cup 34 diverges upwardly, concentrically with the main body 18. The function of the golf cup 34 is to center a golf ball falling into the golf cup 34 relative to the golf cup 34. By Rules of Golf, the outside diameter of the golf cup 34 is 4.25 inches.

The golf cup 34 is provided at its lower end with a co-axial flag stick tube 35. While too small to admit a golf ball, the flag stick tube 35 has a diameter that is large enough to allow the insertion of a flag stick. The solenoid-driven plunger 55 has a diameter slightly smaller than the diameter of the flag stick tube 35, such that the solenoid-driven plunger 55 is able to slide easily up and down the flag stick tube 35.

Although the preferred embodiments described herein and demonstrated in the figures consist of separable components, it should be emphasized that there are no limitations on the structure of the golf ball ejecting apparatus 1. Some components of the golf ball ejecting apparatus 1 may be formed integrally and be welded, cemented or otherwise rigidly affixed in the golf ball ejecting apparatus 1. With the end plate 28 being a removable part of the golf ball ejecting apparatus 1, the solenoid-driven plunger 55, the power source 12, the guide tube 17, the guiding cap 48 and the tapered coil springs 14 can be reached by removing the end plate 28.

The golf ball ejecting apparatus 1 is not automatically actuated. In contrast, the golf ball ejecting apparatus 1 is selectively, simply and quickly actuated by the golfer upon completing a positive, easily performable action. The golf ball ejecting apparatus 1 requires the completion of a positive, easily performable action by the golfer. The golfer needs to pass an object over the top of the golf hole, such that the object passes simultaneously over all the phototransistors 32 before the golf ball ejecting apparatus 1 is actuated. Any object would qualify, as long as the object casts enough of a shadow on the phototransistors 32 to be capable of actuating the phototransistors 32. By simply moving one's foot with a sweeping motion over the golf hole, the golfer can trigger the phototransistors 32 which automatically actuate the golf ball ejecting apparatus 1.

The golf ball ejecting apparatus 1 is operable to eject a golf ball to a height such that the golfer may conveniently catch the golf ball without leaning or stooping. The invention described herein overcomes the limitations of the prior art via the implementation of an actuation means which depends upon the instantaneous alteration of the light intensity within the main body 18 of the golf cup 34 at the sole discretion of the golfer. This is accomplished by moving an object by the golfer smoothly (as with a sweeping motion) over, above and across the golf hole. The triggering mechanism is designed around phototransistors 32 which respond to the rapid return of the light intensity around them following a period of darkness imposed while the object is passed over the top of the golf hole which causes the electrical circuit to actuate and efficiently energize the solenoid system 33 briefly and yet long enough to actuate the solenoid-driven plunger 55.

Upon triggering the phototransistors 32, an electrical control signal is developed. The generated electrical control signal is amplified by an electrical circuit so that the solenoid system 33 is actuated. An electrical circuit is established through the power source 12 and the conductive strip 41. The establishment of the electrical circuit from the power source 12 through the conductive strip 41 and the solenoid coil 21 causes an exertion of an abrupt upward force on the solenoid-driven plunger 55. Therefore, the solenoid-driven plunger 55 moves upwardly with abrupt force, imparting an impacting force to the golf cup 34 and, if present, the golf ball.

The solenoid-driven plunger 55 ejects the golf ball from the golf cup 34 upon selective actuation of the golf ball ejecting apparatus 1. When the solenoid-driven plunger 55 impacts the golf ball, the golf ball will move upwardly above the ground and to the desired elevation. The striking face 10 of the solenoid-driven plunger 55 strikes the golf ball squarely on the bottom side and ejects it vertically upward from the golf ball ejecting apparatus 1. The solenoid-driven plunger 55, then, immediately returns to its position at rest and is ready to be actuated when the next golfer wants to eject his golf ball.

The ease of operation of the golf ball ejecting apparatus 1 is significant, which adds to its intrinsic utility. The phototransistors 32 are designed so as to detect a significant change in light intensity over a wide range of light availability. The golf ball ejecting apparatus 1 is designed to operate at near darkness as well as in full sunlight. When the golfer wants to actuate the solenoid-driven plunger 55, he must simply pass an object over the top of the golf hole with a sweeping motion. When that is done, the object casts a shadow on the phototransistors 32 for a very brief instant, after which the phototransistors 32 are immediately exposed to the full amount of light which is available at that particular time of day. All phototransistors 32 must be exposed to the dark period and return of light simultaneously in order to actuate the golf ball ejecting apparatus 1. The particular arrangement of the phototransistors 32 prevents inadvertent actuation of the phototransistors 32 such as could occur should a leaf fall into the hole, cover one phototransistor 32 and then be moved and cover a different phototransistor 32 while imposing the return of light to the previous phototransistor 32. A golf ball entering the golf cup 34 cannot actuate the golf ball ejecting apparatus 1. All phototransistors 32 must be simultaneously subjected to darkness and then simultaneously subjected to light.

Following a designed brief time delay, the solenoid-driven plunger 55 is actuated and then the golf ball is impacted on its bottom side whereupon it is ejected from the hole to a height above the top of the golf cup 34. Preferably, the golf ball is ejected about 3 to 4 feet above the top of the golf cup 34 in order to facilitate catching of the golf ball by the golfer with one hand. The golfer then replaces the flag stick into its proper flag stick tube 35 within the golf cup 34 and proceeds to the next hole.

Whereas this invention utilizes a solenoid with a plunger so as to maximize its effectiveness and efficiency and it also utilizes the simplicity of phototransistors in the circuitry for the actuation of the solenoid coupled with the inclusion of provision for the normal and usual use of the flagstick and flag, it is easy to recognize the significant improvement over the current state of the art with this invention. Most of the golfing time is spent on the golf course itself rather than simply on a practice putting green where flagsticks and flags are not significant. This invention provides for the all-encompassing usage in the actual game of golf as well as for the practice activities associated with the practice putting aspect of the game, where flags and flagsticks are not used.

The overall assembly provides a unique protection for relatively delicate control components. Such protection is achieved by sealing the solenoid system 33.

The overall characteristics of the golf ball ejecting apparatus 1 are such that the golf cup 34 is practically immune or resistant to breakdowns caused by adverse environmental conditions and is, thus, characterized by a uniquely prolonged operating life. Drainage is provided through the flag stick tube 35 in the golf cup 34, subsequently through the guide tube 17, then through the drainage ports 6, and then through the drain hole 29 in the end plate 28.

The overall simplicity of the system contributes to acceptable low fabrication and installation costs and ensures minimal maintenance efforts and costs.

Actuation of the golf ball ejecting apparatus 1 via means other than phototransistors 32 is obvious to those skilled in the art. For example, infra red technology, radio frequencies, lasers and audio frequencies could be used for the actuation of the golf ball ejecting apparatus 1. Other similar senders and corresponding receivers will perform the task as well. Phototransistors 32 have been used in the preferred embodiment of the golf ball ejecting apparatus 1 so that a golfer could activate the golf ball ejecting apparatus 1 hands-free.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall in between.

What is claimed as invention is:

1. A golf ball ejecting apparatus comprising:

(a) a sleeve being a hollow tube with an upper end and a lower end; and (b) a main body, featuring a solenoid system, that is surrounded by and attached by sealants to the sleeve and that comprises:

i. a guide tube, ii. a solenoid-driven plunger sliding in the guide tube, iii. a power source, iv. a housing for the power source, v. phototransistors that are embedded in the housing for the power source, vi. a flag stick tube positioned above the guide tube, vii. solenoid coil wrapped around the flag stick tube, viii. insulating tape wrapped around the solenoid coil, ix. tapered coil springs connecting the power source to the solenoid coil, x. a control circuit panel placed on the insulating tape and connected to the phototransistors, xi. a golf cup being positioned above the flag stick tube and being closest among other components of the main body to the upper end of the sleeve, and xii. an end plate being positioned under the guide tube and being closest among other components of the main body to the lower end of the sleeve;

wherein a sealant is used:

i. in between the sleeve and the golf cup in order to prevent entrance of any external particles into the main body via any space that may exist between the sleeve and the golf cup; and ii. in between the sleeve and the end plate in order to prevent entrance of any external particles into the main body via any space that may exist between the sleeve and the end plate.

2. The golf ball ejecting apparatus according to claim 1, wherein the end plate has:

(a) a top section, a bottom section and the sealant that seals the end plate to the sleeve and that is between the bottom section and the top section, with a conductive strip being attached to the top section; and (b) a guiding cap being attached to and positioned above and perpendicular to the top section of the end plate and comprising a top portion, drainage ports at the top portion of the guiding cap that lead to a drain hole that passes through the end plate, a bottom portion and a sealant that is between the bottom portion and the top portion of the guiding cap and that seals the guiding cap to the guide tube; such that any fluid that enters the golf ball ejecting apparatus via the golf cup passes through the end plate out of the drain hole; and such that entrance of any foreign matter into the main body is prevented.

3. The golf ball ejecting apparatus according to claim 2, wherein a sealant is used in between the guide tube and the guiding cap of the end plate in order to prevent entrance of any external particles into the main body via the drainage ports of the guiding cap.

4. The golf ball ejecting apparatus according to claim 2, wherein the drain hole is threaded.

5. The golf ball ejecting apparatus according to claim 1, wherein the sleeve shares a central, longitudinal axis with the main body and, thus, with the solenoid-driven plunger, with the guide tube, with the flag stick tube and with the golf cup.

6. The golf ball ejecting apparatus according to claim 1, wherein the sleeve consists of metal, plastic adapted to be mounted into ground of a golf green, with its upper end flush with or slightly below the ground surface and with its end plate resting sufficiently above the lower end of the sleeve to permit drainage of any fluid that enters the golf cup.

7. The golf ball ejecting apparatus according to claim 1, wherein a number of cavities in the main body serve as housing for the power source.

8. The golf ball ejecting apparatus according to claim 7, wherein a number of batteries are used as the power source.

9. The golf ball ejecting apparatus according to claim 7, wherein the power source comprises a number of units arranged in a circumferential arrangement to form a barrier encircling the guide tube, with the power source being used when the solenoid system is actuated.

10. The golf ball ejecting apparatus according to claim 1, wherein each tapered coil spring is inserted into a feed-through hole existing in the housing of the main body when connecting each unit of the power source to the solenoid coil.

11. The golf ball ejecting apparatus according to claim 1, wherein solenoid coil extends from under the optical implant holes adjacent to the phototransistors to where the electrical feed-through holes terminate.

12. The golf ball ejecting apparatus according to claim 1, wherein the phototransistors are embedded in translucent material from which the golf ball ejecting apparatus is constructed.

13. The golf ball ejecting apparatus according to claim 1, wherein three phototransistors are positioned approximately 120 degrees apart around the golf cup, one-half inch from edge of the golf cup and three-sixteenth inch below the golf cup.

14. The golf ball ejecting apparatus according to claim 1, wherein the control circuit panel is glued upon the insulating tape.

15. The golf ball ejecting apparatus according to claim 1, wherein after all connections of different components of the solenoid system are completed and an exposed surface remains, a potting compound is applied to the exposed surface of the solenoid system, such that the solenoid system is waterproofed.

16. The golf ball ejecting apparatus according to claim 15, wherein any conventional, electrically non-conductive, fluid plastic is used as potting compound.

17. A method of operation of a golf ball ejecting apparatus comprising a sleeve and a main body, featuring a solenoid system, having a guide tube, a solenoid-driven plunger sliding in the guide tube, a power source, a housing for the power source, phototransistors that are embedded in the housing for the power source, a flag stick tube positioned above the guide tube, solenoid coil wrapped around the flag stick tube, insulating tape wrapped around the solenoid coil, tapered coil springs connecting the power source to the solenoid coil, a control circuit panel placed on the insulating tape and connected to the phototransistors, a golf cup positioned above the flag stick tube and an end plate positioned under the guide tube, said method comprising:

(a) passing an object simultaneously over the phototransistors, whereby the phototransistors are triggered and an electrical control signal is generated, resulting in:

i. amplification of the generated electrical control signal by an electrical circuit so that the solenoid system is actuated, ii. establishment of an electrical circuit through the solenoid coil and, then, from the power source through the conductive strip, and iii. exertion of an abrupt upward force on the solenoid-driven plunger which, in turn, imparts an impacting force to the golf cup;

such that upon instantaneous alteration of intensity of light shining upon the phototransistors and such that upon a rapid return of light following a period of darkness imposed upon the phototransistors, the golf ball ejecting apparatus is actuated.

18. The method of operation of the golf ball ejecting apparatus according to claim 17, wherein the golf ball ejecting apparatus is capable of operating over a wide range of light availability, ranging from near darkness to full sunlight.

19. The method of operation of the golf ball ejecting apparatus according to claim 17, wherein any fluid which enters the golf cup drains downward through the flag stick tube and through the guide tube, passes around the solenoid-driven plunger and then exits the golf ball ejecting apparatus via the drainage ports and then through the drain hole in the end plate.

* * * * *